US010869588B2

(12) United States Patent
Woo et al.

(10) Patent No.: US 10,869,588 B2
(45) Date of Patent: Dec. 22, 2020

(54) DISHWASHER

(71) Applicant: LG Electronics Inc.

(72) Inventors: Sangwoo Woo, Seoul (KR); Wook Hong, Seoul (KR); Gyuhan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 95 days.

(21) Appl. No.: 16/118,688

(22) Filed: Aug. 31, 2018

(65) Prior Publication Data

US 2019/0059685 A1 Feb. 28, 2019

(30) Foreign Application Priority Data

Aug. 31, 2017 (KR) ..... 10-2017-0111508

(51) Int. Cl.
*A47L 15/42* (2006.01)

(52) U.S. Cl.
CPC ..... *A47L 15/4223* (2013.01); *A47L 15/4225* (2013.01); *A47L 15/4234* (2013.01)

(58) Field of Classification Search
CPC ..... A47L 15/42
See application file for complete search history.

(56) References Cited

U.S. PATENT DOCUMENTS

2015/0359411 A1* 12/2015 Kim ..... A47L 15/4285 134/18
2017/0196432 A1 7/2017 Kim et al.

FOREIGN PATENT DOCUMENTS

EP 2954828 12/2015

OTHER PUBLICATIONS

European Office Action in European Application No. 102018121284.4, dated Mar. 31, 2020, 14 pages (with English translation).

* cited by examiner

*Primary Examiner* — Jason Y Ko
(74) *Attorney, Agent, or Firm* — Fish & Richardson P.C.

(57) ABSTRACT

Provided is a dishwasher for spraying washing water or steam to wash dishes or cooking appliances. The dishwasher according to the present invention includes: a case; a tub which is provided inside the case to form a washing space where a target of washing is received; a spray arm which sprays washing water into the tub; a sump which is disposed under the tub to store the washing water; a washing pump which supplies the washing water stored in the sump to the spray arm and generates steam; a steam nozzle which sprays the steam generated in the washing pump to the washing space; and a steam hose which connects the washing pump and the steam nozzle, wherein the sump comprises a steam hose supporter that supports the steam hose.

20 Claims, 11 Drawing Sheets

DISHWASHER

CROSS-REFERENCE TO RELATED APPLICATION

This application claims the priority benefit of Korean Patent Application No. 10-2017-0111508, filed on Aug. 31, 2017, in the Korean Intellectual Property Office, the disclosure of which is incorporated herein by reference.

FIELD

The present invention relates to a dishwasher and, more particularly, to a dishwasher that sprays washing water and steam to wash dishes and cooking appliances.

BACKGROUND

A dishwasher is a home appliance for washing foreign substance such as food waste remaining in a dish, a cooking appliance, and the like (hereinafter, referred to as a "target of washing") by high-pressure washing water sprayed from a spray arm.

The dishwasher generally consists of a tub forming a washing space, and a sump mounted to the bottom of the tub. In addition, the washing water moves to the spray arm by a pumping operation of the washing pump mounted in the sump. The washing water having moved to the spray arm is sprayed with high pressure through a spray hole formed in the spray arm. Then, the washing water sprayed with high pressure hits the surface of a target of washing to remove foreign substance remaining in the target of washing.

Meanwhile, the dishwasher washes a target of washing with heated washing water, or washes or sanitize a target of washing with steam. As a way of efficiently generating steam, there is proposed that a heater is installed in a washing pump to generate steam. In addition, there is proposed that a steam nozzle for spraying steam is disposed at a lower end of a door in order to allow the steam to efficiently act on the target of washing.

However, while the steam generated in the washing pump reaches the steam nozzle through a hose, water may be condensed and remain in the hose to prevent the steam from being supplied smoothly. In addition, if water leaks from the hose, the water may flow into the washing pump, causing a breakdown of the washing pump.

SUMMARY

One object of the present invention is to provide a dishwasher that supplies steam generated in a washing pump to a steam nozzle smoothly.

Another object of the present invention is to provide a dishwasher in which water leaking from a steam supply hose does not affect a washing pump.

Objects of the present invention should not be limited to the aforementioned objects and other unmentioned objects will be clearly understood by those skilled in the art from the following description.

In accordance with an embodiment of the present invention, the above and other objects can be accomplished by the provision of a dishwasher including: a case; a tub which is provided inside the case to form a washing space where a target of washing is received; a spray arm which sprays washing water into the tub; a sump which is disposed under the tub to store the washing water; a washing pump which supplies the washing water stored in the sump to the spray arm and generates steam; a steam nozzle which sprays the steam generated in the washing pump to the washing space; and a steam hose which connects the washing pump and the steam nozzle, wherein the sump comprises a steam hose supporter that supports the steam hose.

The washing pump may include a steam discharge pipe through which steam is discharged, the steam hose may be connected to the steam discharge pipe, and the steam hose supporter may be disposed higher than an upper end of the steam discharge pipe and lower than a lower end of the steam nozzle.

The washing pump may include a washing water outflow pipe through which washing water flows out, and which is connected to the spraying arm, and the steam discharge pipe may be disposed in the washing water outflow pipe.

The steam discharge pipe may be disposed such that a steam outflow direction is inclined upwardly.

The sump further may include a washing pump connection member that connects the steam hose supporter and the washing pump so as to fix the washing pump to the sump.

The steam hose supporter may cover at least a part of a top surface of the washing pump.

The washing pump may include: an impeller for causing washing water to flow; and a motor for rotating the impeller, and the steam hose supporter may cover at least a part of a top surface of the motor.

The steam hose may be disposed to be inclined upwardly from the washing pump to the steam nozzle, or disposed to face a horizontal direction.

The sump further may include a sump body coupled to a bottom of the tub, and the steam hose supporter may extend horizontally from the sump body.

The steam hose supporter may include: a supporting main body which is in a plate shape extending in a horizontal direction; and a support end which is in a beam shape extending horizontally from the supporting main body, and which supports the steam hose. A surface of the support end in contact with the steam hose may be inclined upwardly.

The steam hose support further may include a support protrusion that protrudes upwardly from the support end and surrounds a side surface and a part of a top surface of the steam hose.

The dishwasher may further include a door provided at a front surface of the tub to open and close the washing space, and the steam nozzle may be provided at the door.

The steam hose may be disposed from the steam hose supporter toward the door.

The steam hose may be disposed to be inclined upwardly from the steam hose supporter to the door, or disposed to face a horizontal direction.

The washing pump may include a pump upper portion in which an impeller for pumping washing water is provided, and the steam hose may be connected to the pump upper portion.

Details of other embodiments will be described in the detailed description with reference to the accompanying drawings.

The dishwasher including the same according to the present invention provide at least the following effects.

First, since a steam hose, which supplies steam generated in a washing pump to a steam nozzle, is not inclined downwardly with reference to a moving direction of the steam, water does not remain in the steam hose.

Second, since water leaking from the steam hose does not affect the washing pump, a breakdown of the washing pump may be prevented.

Third, the steam hose is stably fixed, and thus, steam is supplied stably.

It should be understood that advantageous effects according to the present invention are not limited to the effects set forth above and other advantageous effects of the present invention will be apparent from the detailed description of the present invention.

BRIEF DESCRIPTION OF THE DRAWINGS

The embodiments will be described in detail with reference to the following drawings in which like reference numerals refer to like elements wherein.

DETAILED DESCRIPTION

Figure 1:
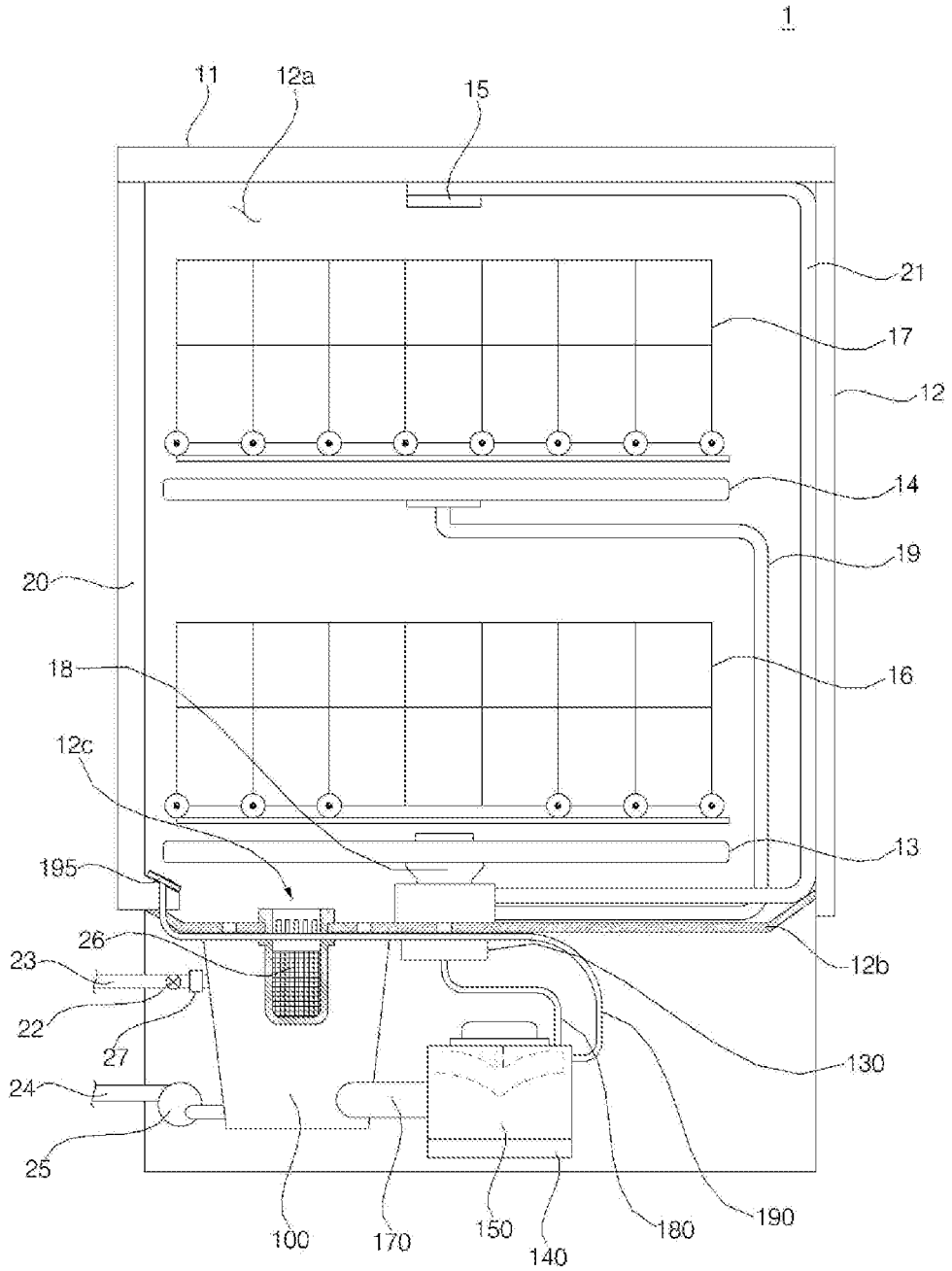
FIG. 1 is a schematic diagram illustrating a structure of a dishwasher according to an embodiment of the present invention.

Advantages and features and methods for achieving those of the present disclosure may become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope. The same reference numerals may refer to the same elements throughout the specification.

Hereinafter, a dishwasher according to embodiments of the present invention will be described with the accompanying drawings.

Figure 2:
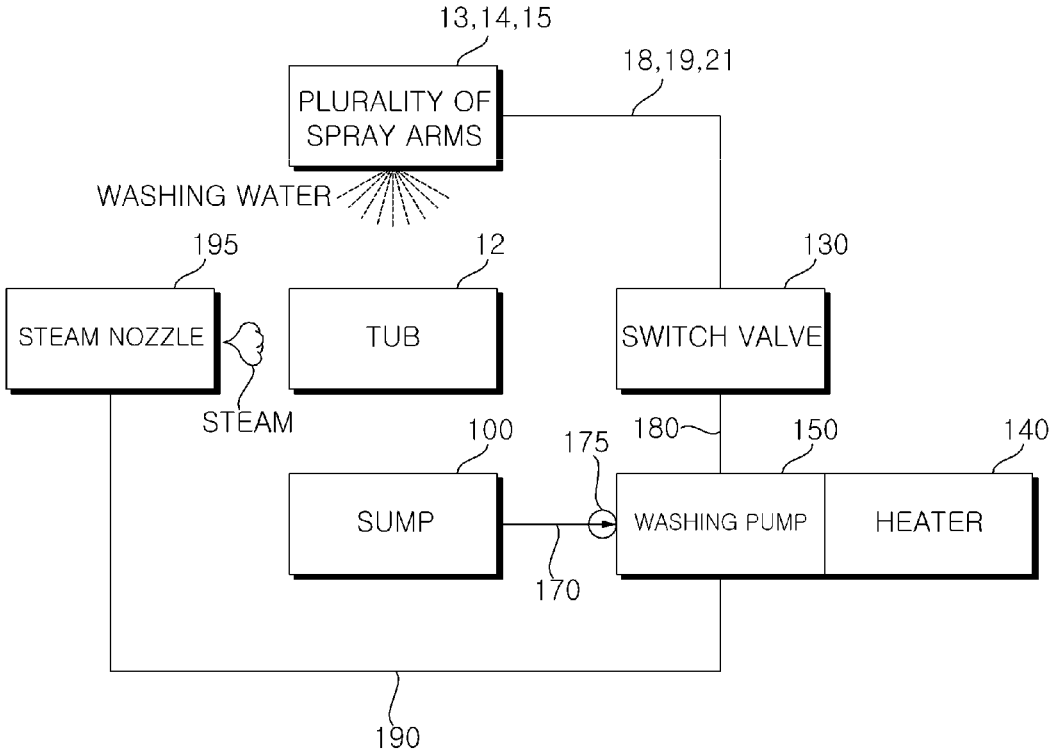
FIG. 2 is a diagram illustrating a configuration of a dishwasher according to an embodiment of the present invention.

FIG. 1 is a schematic diagram illustrating a structure of a dishwasher according to an embodiment of the present invention, and FIG. 2 is a diagram illustrating a configuration of a dishwasher according to an embodiment of the present invention.

A dishwasher 1 according to an embodiment of the present invention includes: a case 11 which forms an exterior of the dishwasher 1; a tub 12 which is provided inside the case 11 and forms a washing space 12*a* where a target of washing is received; a door 20 which is provided at a front surface of the tub 12 and used to open/close the washing space 12*a*; a sump 100 which is provided under the tub 12 to store washing water; a plurality of spray arms 13, 14, and 15 which spray washing water into the tub 12; a washing pump 150 which supplies washing water stored in the sump 100 to the plurality of spray arms 13, 14, and 15 and generates steam; a steam nozzle 195 which is provided in the door 20 and sprays the stream generated in the washing pump 150 to the washing space 12*a*; and a steam hose 190 which connects the washing pump 150 and the steam nozzle 195.

The tub 11 is in a cubical shape having an open front surface, and includes the washing space 12*a* formed therein. At a bottom 12*b* of the tub 11, a communication unit 12*c* through which washing water flows into the sump 100. A plurality of racks 16 and 17 where targets of washing are received is provided in the washing space 12*a*. The plurality of racks 16 and 17 includes a lower rack 16 disposed in a lower portion of the washing space 12*a*, and an upper rack 17 disposed in an upper portion of the washing space 12*a*. The lower rack 16 and the upper rack 17 may be spaced apart from each other, and may slide out in a forward direction from the tub 11 to be withdrawn.

The plurality of spray arms 13, 14, and 15 are disposed in an upward-downward direction. The plurality of spray arms 13, 14, and 15 includes: a lower spray arm 13 disposed lowest among the spray arms 13, 14, and 15 to spray washing water in an upward direction toward the lower rack 16; an upper spray arm 14 disposed over the lower spray arm 13 to spray washing water in an upward direction toward the upper rack 17; and a top spray arm 15 disposed at a top of the washing space 12*a*, which is positioned over the upper spray arm 14, to spray washing water in a downward direction.

The plurality of spray arms 13, 14, and 15 is supplied with washing water from the washing pump 150 through a plurality of spray arm connection passages 18, 19, and 21. The plurality of spray arm connection passages 18, 19, and 21 includes a low spray arm connection passage 18 connected to the lower spray arm 13, an upper spray arm connection passage 19 connected to the upper spray arm 14, and a top spray arm connection passage 21 connected to the top spray arm 15.

The sump 100 is disposed under the bottom 12*b* of the tub 12 and collects washing water. The sump 100 is connected to a water supply passage 23 in which washing water supplied from an external water source flows. A water supply valve 22 for controlling washing water supplied from the external water source is provided in the water supply passage 23. When the water supply valve 22 is opened, the washing water supplied from the external water source flows into the sump 100 through the water supply passage 23. The water supply passage 23 includes a flow meter 27 for measuring an amount of washing water flowing into the sump 100 through the water supply passage 23.

The sump 100 is connected to a drain passage 24 through which stored washing water is guided to an outside of the dish waster. A drain pump 25 for draining washing water from the sump 100 through the drain passage 24 is provided in the drain passage 24. When the drain pump 25 is driven, washing water stored in the sump 100 flows out of the case 11 through the drain passage 24. The sump 100 will be described in more detail below following FIG. 7.

A filter 26 is mounted at a communication hole 12*c*, and filters out foreign substances from washing water that flows from the tub 12 to the sump 100.

The washing pump 150 supplies washing water stored in the sump 100 to at least one of the plurality of spray arms 13, 14, and 15. The washing pump 150 is connected to a switch valve 130 and a washing water supply passage 180.

When the washing pump 150 is driven, washing water stored in the sump 100 flows into the washing pump 150 through a water collection passage 170 and is then pumped to the switch valve 130 through a washing water supply passage 180. The washing pump 150 may heat washing water moving to the washing water supply passage 180.

The washing pump 150 generates steam by heating washing water stored therein. The washing pump 150 is connected to the steam hose 190. Steam generated in the washing pump 150 is supplied to the steam nozzle 195 through the stream hose 190.

The washing pump 150 is installed on one lateral side of the sump 100. The washing pump 150 will be described in more detail with reference to FIGS. 3 to 6.

The heater 140 is coupled to a lower end of the washing pump 150 to heat washing water within the washing pump 150. The heater 140 generates hot water by heating washing water that flows in the washing pump 150 when the washing pump 150 operates.

The hot water generated by the heater 140 is sprayed into the tub 12 through at least one of the plurality of spray arms 13, 14, and 15. The steam generated by the heater 140 flows along the steam hose 190 and is then discharged into the tub 12 through the steam nozzle 195.

The steam nozzle 195 is provided at a lower end of the door 200 and sprays steam to the washing space 12*a*. The steam sprayed from the steam nozzle 195 acts on a target of washing received in the lower rack 16 and/or the upper rack 17.

The switch valve 130 connects the sump 100 to at least one of the plurality of spray arms 13, 14, and 15. The switch valve 130 selectively supplies washing water, pumped by the washing pump 150, to at least one of the low spray arm 13, the upper spray arm 14, or the top spray arm 15. The switch valve 130 selectively connects the washing water supply passage 180 to at least one of the plurality of spray arm connection passage 18, 19, and 21. The switch valve 130 may be disposed in the sump 100.

The check valve 175 is disposed between the sump 100 and the washing pump 150 and is capable of being opened in a direction from the sump 100 to the washing pump 150. The check valve 175 is opened to allow washing water to flow from the sump 100 to the washing pump 150, and the check valve 175 is closed not to allow stream to flow from the washing pump 150 to the sump 100. A lower portion of the check valve 175 is rotated relative to an upper portion of the check valve 175 such that the check valve 175 is opened. The check valve 175 is disposed inside the water collection passage 170 or connected between the water collection passage 170 and the washing pump 150 so as to open and close the water collection passage 170.

The check valve 175 is closed when the heater 140 generates steam. When washing water flows upon operation of the washing pump 150, the check valve 175 is opened. When washing water stops flowing upon deactivation of the washing pump 150, the check valve 175 is closed. The check valve 175 is opened due to pressure of washing water pumped by the washing pump 150. In some implementations, the check valve 175 may be a solenoid valve that is opened and closed in accordance with an electronic signal.

The check valve 175 is formed to allow washing water to flow from the washing pump 150 to the sump 100 even in a closed state while the drain pump 25 operates.

Figure 3:
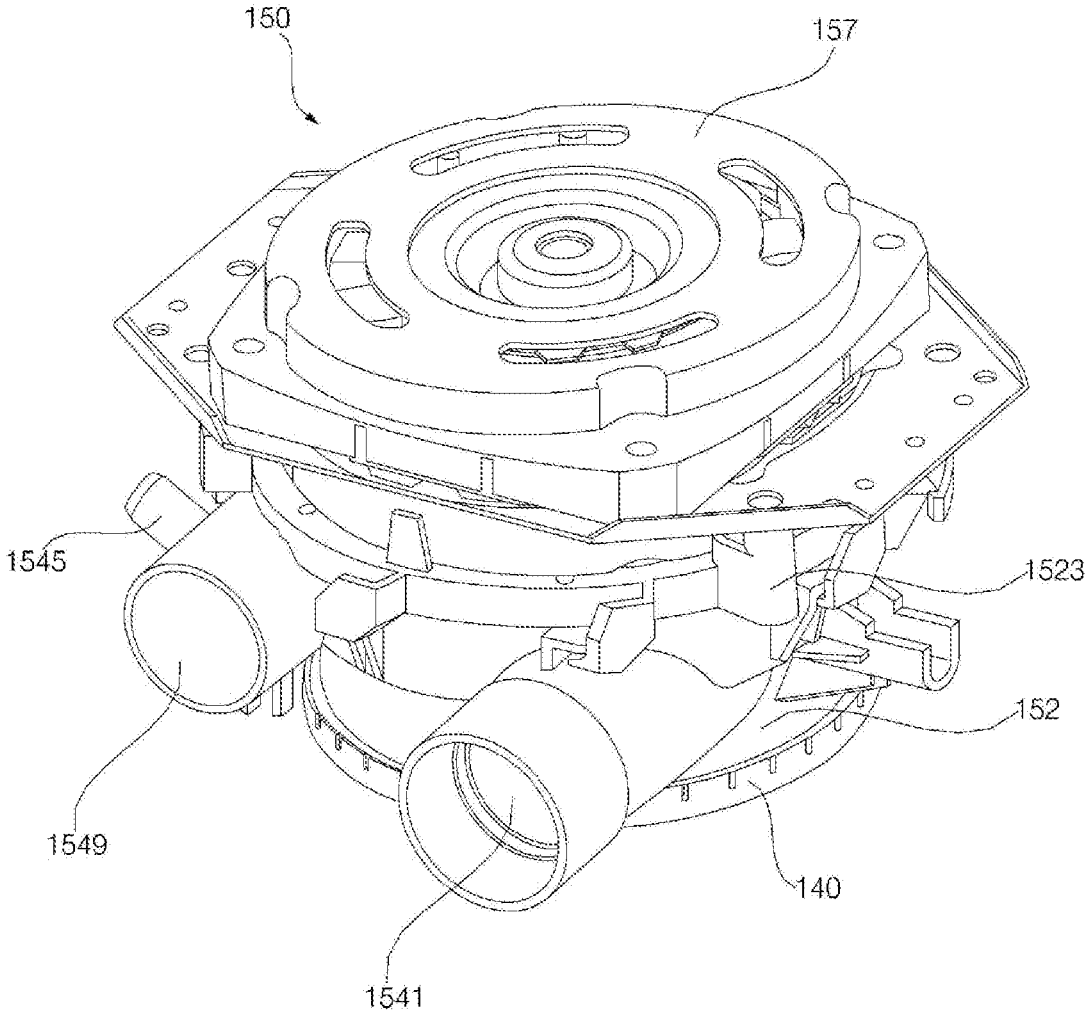
FIG. 3 is a perspective view of a washing pump according to an embodiment of the present invention
Figure 4:
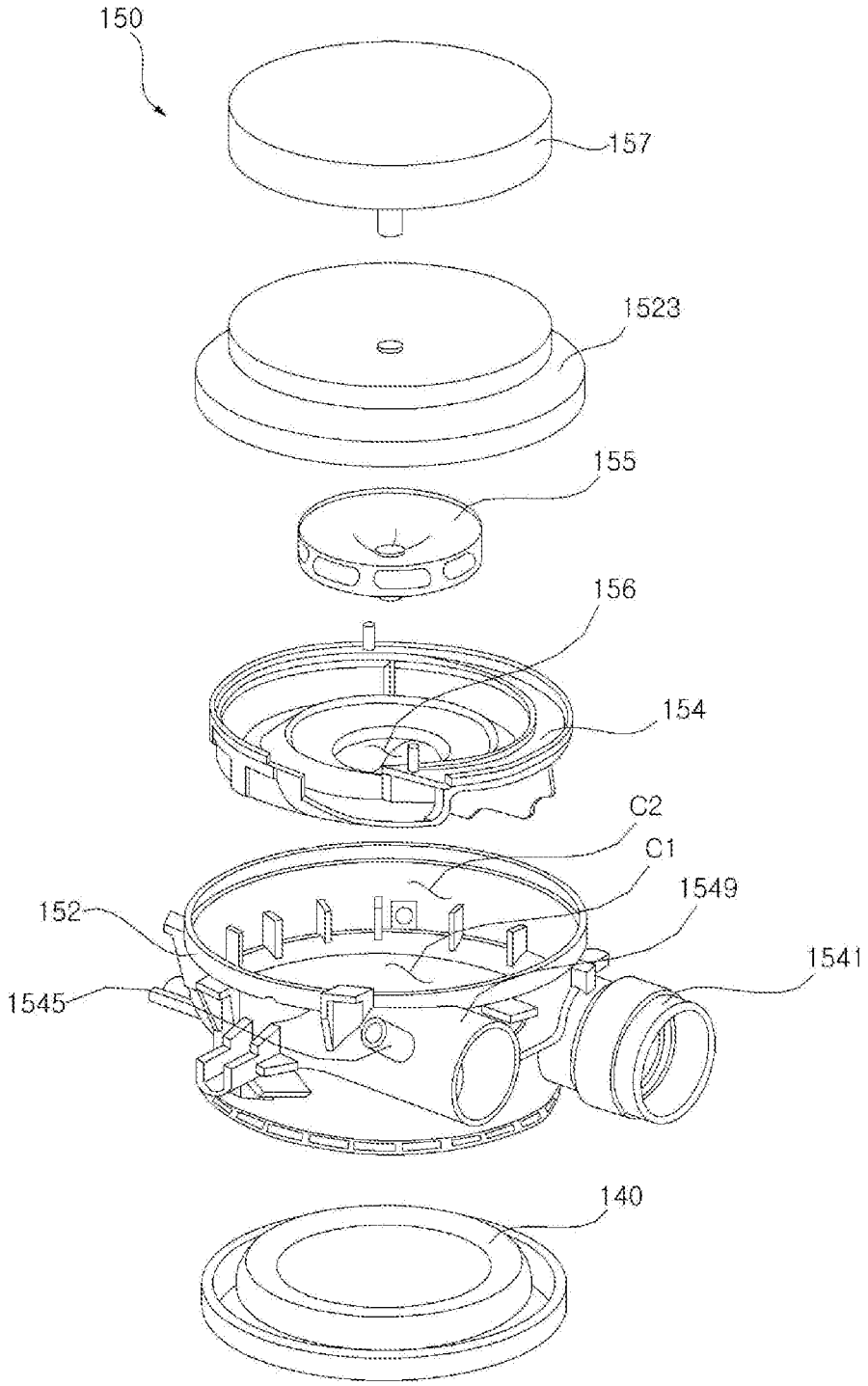
FIG. 4 is an exploded perspective view of a washing pump of a dishwasher according to an embodiment of the present invention.
Figure 5:
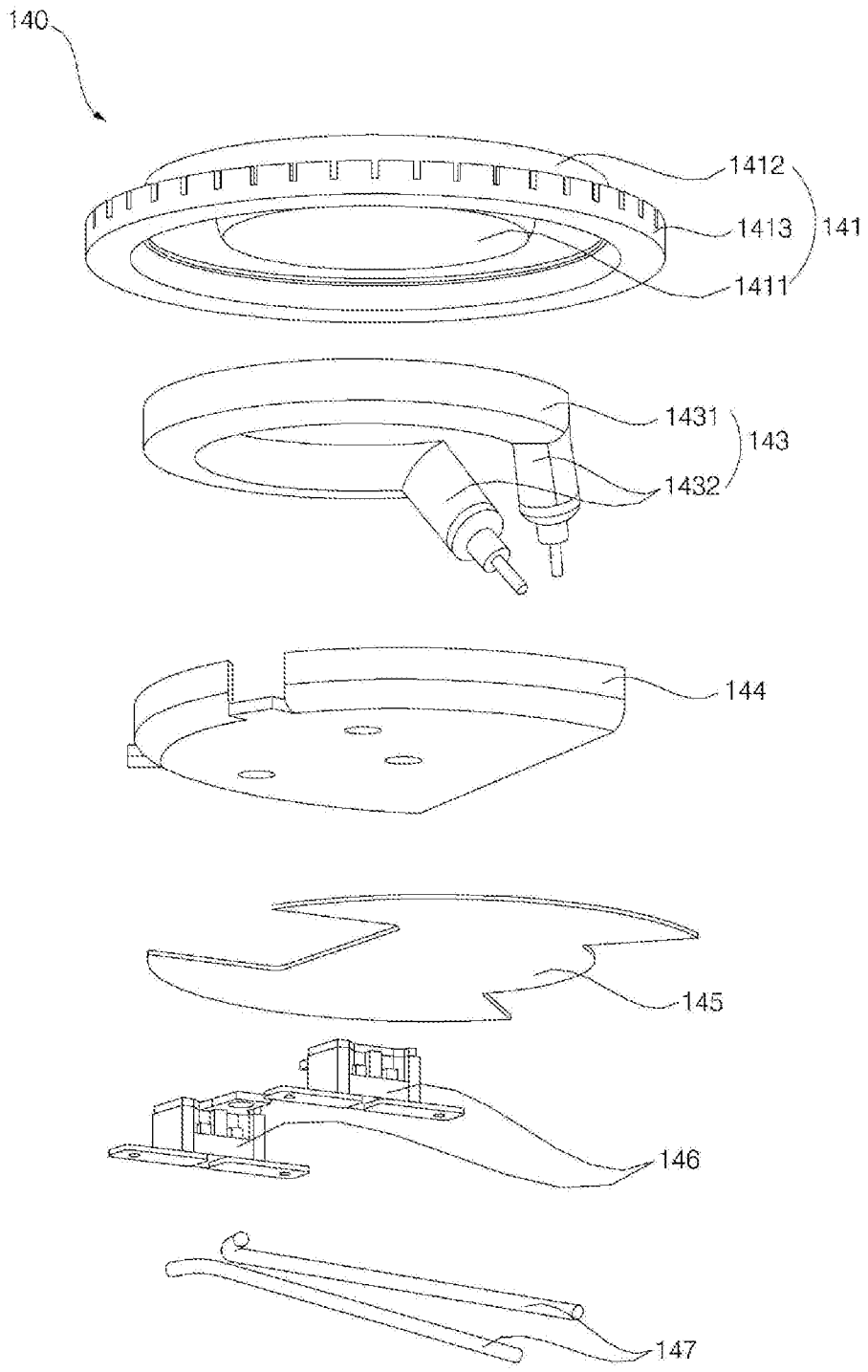
FIG. 5 is an exploded perspective view of a heater according to an embodiment of the present invention.
Figure 6:
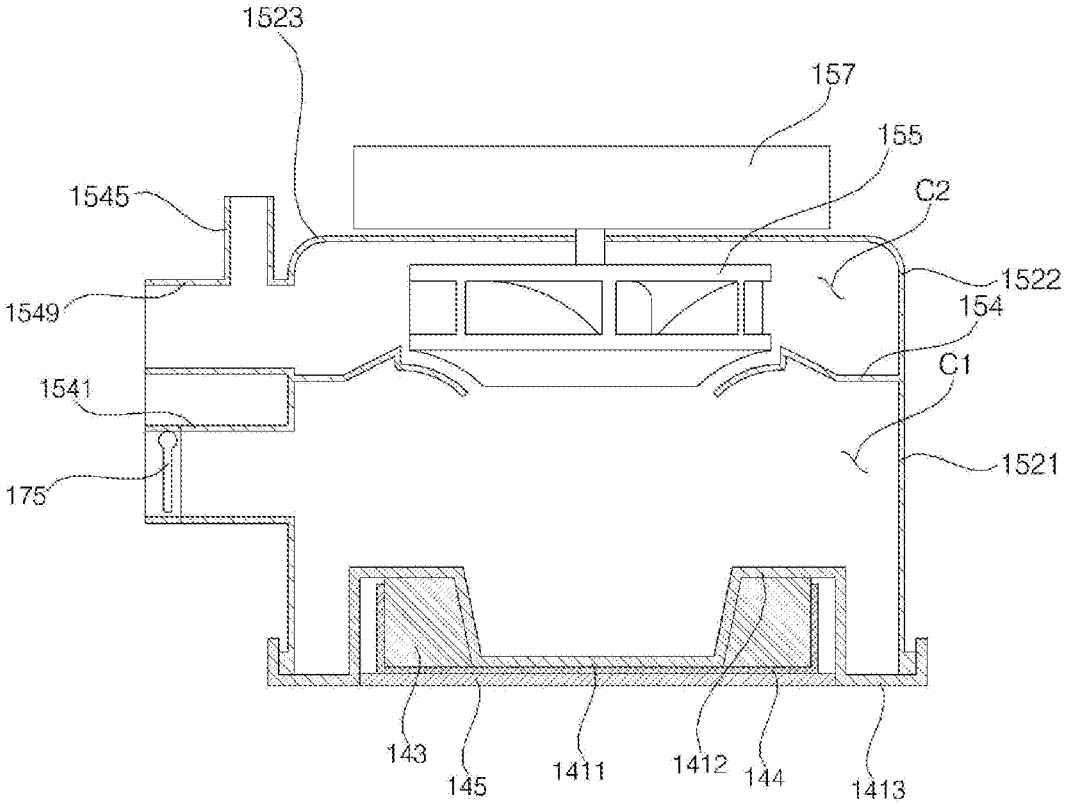
FIG. 6 is a schematic cross-sectional view of a washing pump according to an embodiment of the present invention.

FIG. 3 is a perspective view of a washing pump according to an embodiment of the present invention, FIG. 4 is an exploded perspective view of a washing pump of a dishwasher according to an embodiment of the present invention, FIG. 5 is an exploded perspective view of a heater according to an embodiment of the present invention, and FIG. 6 is a schematic cross-sectional view of a washing pump according to an embodiment of the present invention.

A washing pump 150 according to an embodiment of the present invention includes: a cylindrical housing 152 which is coupled to a sump 100; a washing water inflow pipe 1541 which is connected to the housing 152 to allow washing water to enter; a washing water outflow pipe 1549 which is connected to the housing 152 to allow washing water to flow out; an impeller 155 disposed inside the housing 152 to allows washing water flown into the washing water inflow pipe 1541 to flow out to the washing water outflow pipe 1549; a heater 140 which is coupled to the housing 152 to heat the washing water in the housing 152 so as to generate heat; and a steam discharge pipe 1545 disposed in the washing water outflow pipe 1549 to discharge steam generated by the heater 140.

The housing 152 is formed in a cylindrical shape with a top surface and a bottom surface which are open. The housing 152 is coupled to the sump 100. A top of the housing 152 is coupled to a housing cover 1523, and a bottom of the housing 152 is coupled to the heater 140. The housing cover 1523 covers the top of the housing 152, and the motor 157 generating a rotational force to rotate the impeller 155 is provided in the housing cover 1523.

A partition wall 154 is disposed inside the housing 152. The partition wall 154 is disposed at the middle end of the housing 152 to vertically divide an inner space of the housing. The partition wall 154 is disposed under the impeller 155. The partition wall 154 is disposed over the washing water inflow pipe 1541 and under the washing water outflow pipe 1549. The partition wall 154 forms a lower chamber C1 and an upper chamber C2 in the housing 152. The lower chamber C1 is a space where negative pressure is generated by rotation of the impeller 155, and the upper chamber C2 is a space where positive pressure is generated by rotation of the impeller 155. The lower chamber C1 is connected to the sump 100 through a water collection passage 170 and the washing water inflow pipe 1541. The upper chamber C2 is connected to a switch valve 130 through the washing water outflow pipe 1549 and a washing water supply passage 180. In addition, the upper chamber C2 is connected to the steam nozzle 195 through the steam discharge pipe 1545 and a steam hose 190.

The partition wall 154 divides the washing pump 150 into a pump lower portion 1521 and a pump upper portion 1522. Washing water enters into the pump lower portion 1521, and the lower chamber C1 is formed in the pump lower portion 1521. The pump lower portion 1521 includes a lower portion of the housing 152 and the washing water inflow pipe 1541. The pump lower portion 1521 may further include a heater cover 151 of the heater 140.

The pump upper portion 1522 discharges washing water or steam to an outside, and the upper chamber C2 is formed in the pump upper portion 1522. The pump upper portion 1522 includes an upper portion of the housing 152, the washing water outflow pipe 1549, the steam discharge pipe 1545, and the housing cover 1523. The impeller 155 is disposed inside the pump upper portion 1522, and the motor 157 is disposed over the pump upper portion 1522.

A partition wall hole 156 through which the lower chamber C1 and the upper chamber C2 communicate each other is formed in the partition wall 154. A surface of the partition wall 154 facing the upper chamber C2 is in a volute form to guide washing water, which has entered into the upper chamber C2 from the lower chamber C1 through the partition wall 156, to the washing water outflow pipe 1549. A guider (not shown) protruding downwardly is formed in a lower surface of the partition wall 154 facing the lower chamber C1. The guider of the partition wall 154 guides washing water, which has entered into the lower chamber C1 through the washing water inflow pipe 1541, to the partition wall hole 156. The guider of the partition wall 154 allows washing water in the lower chamber C1 to be uniformly heated by the heater 140.

The impeller 155 rotates by the motor 157 to cause washing water in the housing 152 to flow such that the washing water is discharged to an outside of the housing 152. The impeller 155 is rotatably disposed inside the upper chamber C2. The impeller 155 moves washing water, which has entered from the lower chamber C1 into the upper chamber C2 through the partition wall 156, to the washing water outflow pipe 1549.

The heater 140 is connected to the lower end of the housing 152 and forms a bottom surface of the housing 152. When the impeller 155 rotates, the heater 140 heats washing water that is flowing in the housing 152. Then, when the impeller 155 stops rotating, the heater 140 generates steam by heating washing water in the housing 152. The heater 140 is disposed under the washing water inflow pipe 1541. The heater 140 is disposed under the partition wall 154. A part of the heater 140 is disposed inside the housing 152.

The washing water inflow pipe 1541 is connected to one side of the lower chamber C1 of the housing 152. The washing water inflow pipe 1541 is connected to the water collection passage 170 such that washing water in the sump 100 flows into the lower chamber C1. The washing water inflow pipe 1541 is disposed to protrude outward from a lower side wall of the housing 152. The washing water inflow pipe 1541 is disposed in a horizontal direction.

The washing water outflow pipe 1549 is connected to one side of the upper chamber C2 of the housing 152. The washing water outflow pipe 1549 is connected to the washing water supply passage 180 such that washing water in the upper chamber C2 outflows to the washing water supply passage 180. The washing water outflow pipe 1549 is disposed to protrude outward from an upper side wall of the housing 152. The washing water outflow pipe 1549 is disposed in a horizontal direction, so that a washing water outflow direction is horizontal. The washing water outflow pipe 1549 is disposed higher than the washing water inflow pipe 1541. A washing water outflow direction of the washing water outflow pipe 1549 is opposite to a washing water inflow direction of the washing water inflow pipe 1541.

The steam discharge pipe 1545 is connected to the upper chamber C2 of the housing 152. The steam discharge pipe 1545 may be disposed at any of various positions in the housing 152 so as to connect the upper chamber C2 of the housing 152 and the steam hose 190, and, in this embodiment, the steam discharge pipe 1545 is disposed in the washing water outflow pipe 1549. The steam discharge pipe 1545 discharges the steam, which is generated by the heater 140 in the housing 152, to the steam hose 190. The steam hose 190 is connected to the upper chamber C2 via the steam discharge pipe 1545. The steam discharge pipe 1545 is disposed to be inclined such that a steam outflow direction is inclined upwardly. The steam outflow direction of the steam discharge pipe 1545 is vertical to a washing water outflow direction of the washing water outflow pipe 1549.

The check valve 175 is coupled to the washing water inflow pipe 1541. An upper end of the check valve 175 is coupled to an upper end of the washing water inflow pipe 1541. The check valve 175 is opened when the impeller 155 rotates, and the check valve 175 is closed when the impeller 155 stops rotating. The check valve 175 is opened when the motor 157 operates, and the check valve 175 is closed when the motor 157 stops operating. The check valve 175 is closed when the heater 140 generates steam, so that the steam generated in the housing 152 is prevented from leaking to the sump 100 through the lower chamber C1 and the washing water inflow pipe 1541.

The check valve 175 is formed to allow washing water to flow from the washing pump 150 to the sump when the discharge pump 25 operates. When the check valve 175 is closed, a part of a lower portion of the washing water inflow pipe 1541 is opened. The check valve 175 covers 50% to 90%, preferably 70%, of a cross-sectional area of the washing water inflow pipe 1541 when the check valve 175 is closed.

While the heater 140 generates steam, the check valve 175 is closed not to allow washing water to flow from the washing pump 150 to the sump 100. When the drain pump 25 and the motor 157 stop (when they stop operating), the check valve 175 stores washing water in the housing 152. The heater 140 generates steam by heating the washing water, stored in the housing 152, by the check valve 175.

The heater 140 according to an embodiment of the present invention includes: a heater cover 141 which forms a bottom surface of the housing 152; a heating element 143 which is disposed in contact with a lower side of the bottom surface of the heater cover 141 to heat the heater cover 141; a heater plate 144 which is bonded to a bottom of the heating element 143 and the heater cover 141 to transfer heat of the heating element 143 to the heater cover 141; a thermostat 146 which supplies power to the heating element 143 and adjusts temperature of the heating element 143; a wire 147 which electronically connects the heating element 143 and the thermostat 143 with each other; and a heater shield 145 which is disposed under the heater plate 144 to cover a part of the heater plate 144.

The heater cover 141 is coupled to the lower end of the housing 152 to form a bottom surface of the housing 152 of the washing pump 150. A top surface of the heater cover 141 comes into contact with washing water. The heating element 143 and the heater plate 144 are bonded to the bottom of the heater cover 141. The heater cover 141 is heated by the heating element 143 and the heater plate 144 to thereby heat washing water.

A circumference of the heater cover 141 is formed in a circular shape, and has a plurality of vertical bends on a concentric circle. A part of the heater cover 141 is in a ring shape protruding upwardly (toward the partition wall 154 of the washing pump 150). A part of the heater cover 141 protrudes inward of the housing 152 to form a ring-shaped space where a part of the heating element 143 is received. A part of the heater cover 141 is disposed between washing water received in the housing 152 and the heating element 143.

The heater cover 141 includes a cover base 1411 in a disk shape, a cover holder 1412 protruding upward from a circumference of the cover base 1411, and a cover rim 1413 formed on a circumference of the cover holder 1412 to be coupled to the housing 152.

The cover base 1411 is in a disk shape to form a central portion of the heater cover 141. A central portion of the heater plate 144 is bonded to a bottom of the cover base 1411. The cover base 1411 and the central portion of the heater plate 144 are bonded by brazing.

The cover holder 1412 is formed in a ring shape protruding upward. The cover holder 1412 forms a ring-shaped space where a part of the heating element 143 is received. A main heating element 1431 of the heating element 143, which will be described later on, is received in the ring-shaped space of the cover holder 1412. A part of the heating element 143 is bonded to the inside of the cover holder 1412. The cover holder 1412 and the part of the heating element 143 are bonded by brazing.

The cover holder 1412 is formed by an open curve such that a vertical cross-section in a radial direction from the center of the cover holder 1412 has an open bottom. At least a part of the cover holder 1412 is formed to correspond to a shape of a part of the heating element 143, the part of the heating element 143 being received in the ring-shaped space of the cover holder 1412. The cover holder 1412 directly contact the part of the heating element 143, while receiving the part of the heating element 143. An internal surface of an external circumference of the cover holder 1412 is spaced apart from a partial external circumferential surface of the heating element 143, the part of the heating element 1413 being received in the ring-shaped space of the cover holder 1412.

The cover rim 1413 is in a rim shape. The cover rim 1413 is formed to surround a lower circumference of the housing 152. A peripheral edge of the cover rim 1413 protrude upward to be coupled to the housing 152. Since the cover rim 1413 is not brought into contact with the heater plate 144 and the heating element 143, the cover rim 1413 is heated to a relatively lower temperature.

The heating element 143 generates heat by being supplied with power from the thermostat 146 through the wire 147. The heat element 143 heats the heater cover 141 and the heater plate 144. The heater cover 141 is bonded to a top of the heating element 143 by brazing, and the heater plate 144 is bonded to the bottom of the heat element 143 by brazing.

A partial external circumference of the heating element 143 is spaced apart from a part of the heater cover 141, which forms a ring-shaped space. The part of the heating element 143 is received within the ring-shaped space formed in the heater cover 141 and disposed inside the housing 152. Since the heating element 143 is disposed under the heater cover 141 which forms the bottom surface of the housing 152, the heating element 143 is disposed outside the washing pump 150 while a part of the heating element 143 is disposed inside the housing 152.

The heating element 143 includes the main heating element 1431 which generates heat and which is in an arc shape, and a heating terminal 1432 which supplies power to the heating main body 1431.

The main heating element 1431 is formed in a large arc shape with a central angle of 180° or greater. The main heating element 1431 is received within the cover holder 1412. A top surface and an internal circumferential surface of the main heating element 1431 are brought into contact with the heater cover 141 and heat the heater cover 141. A lower surface and an external circumferential surface of the main heating element 1431 are brought into contact with the heater plate 144 and heat the heater plate 144. The main heating element 1431 is disposed higher than the lower end of the housing 152.

The heating terminal 1432 is supplied with power from the thermostat 146 through the wire 147 and transfers the power to the main heating element 1431. The heating terminal 1432 is provided as a plurality of heating terminals at both ends of the main heating element 1431. A plurality of heating terminals 1431 extends from the both ends of the main heating element 1431 to be inclined downwardly. That is, the plurality of heating terminal 1432 protrudes downward from a plane that is formed by the bottom of the main heating element 1431.

The heater plate 144 is heated by the heating element 143 to thereby heat the cover base 1411 of the heater cover 141. The heater plate 144 uniformly distributes heat of the heating element 143 to thereby uniformly heat the heater cover 141. The heater plate 144 is formed in a bowl shape. An internal circumferential surface of the heater plate 144 is brought into contact with the heating element 143, but an external circumferential surface of the heater plate 144 is spaced apart from the heater cover 141. The heater shield 145 is disposed under the heater plate 144.

Figure 7:
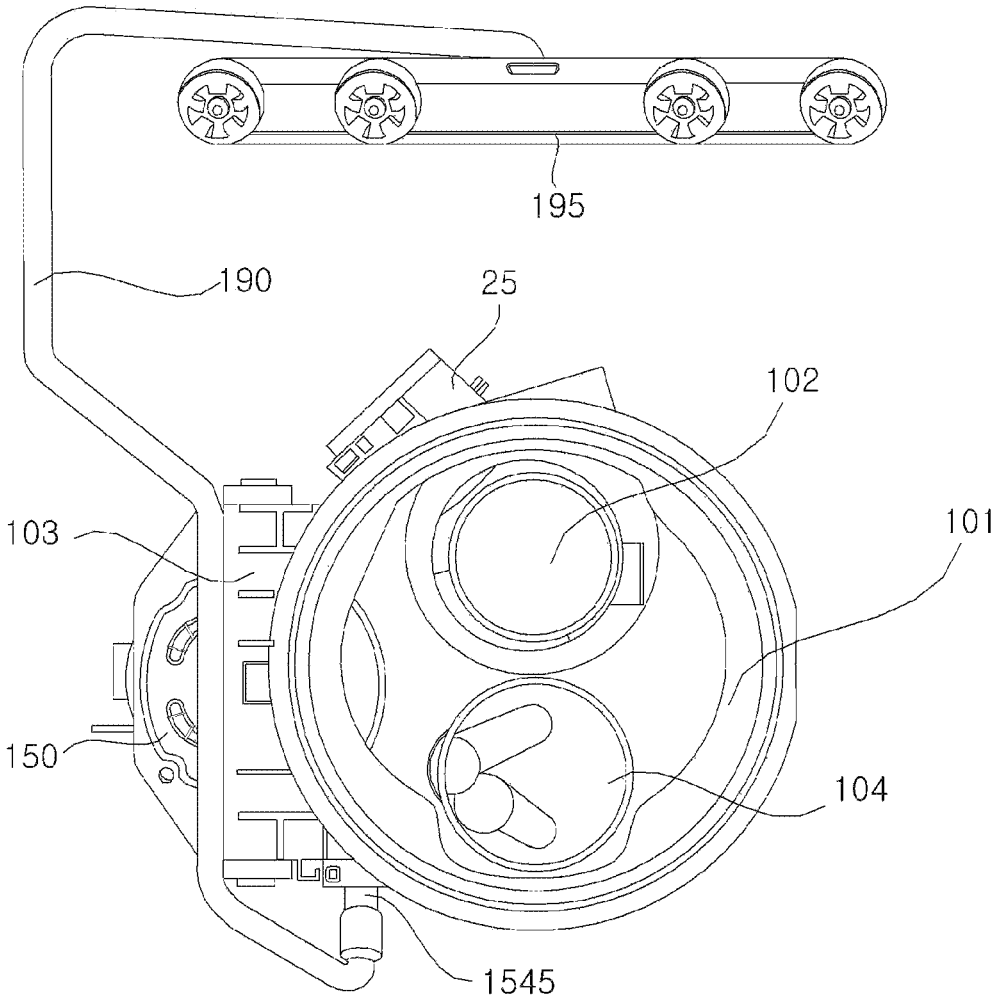
FIG. 7 is a plan view of a part of a dishwasher according to an embodiment of the present invention.
Figure 8:
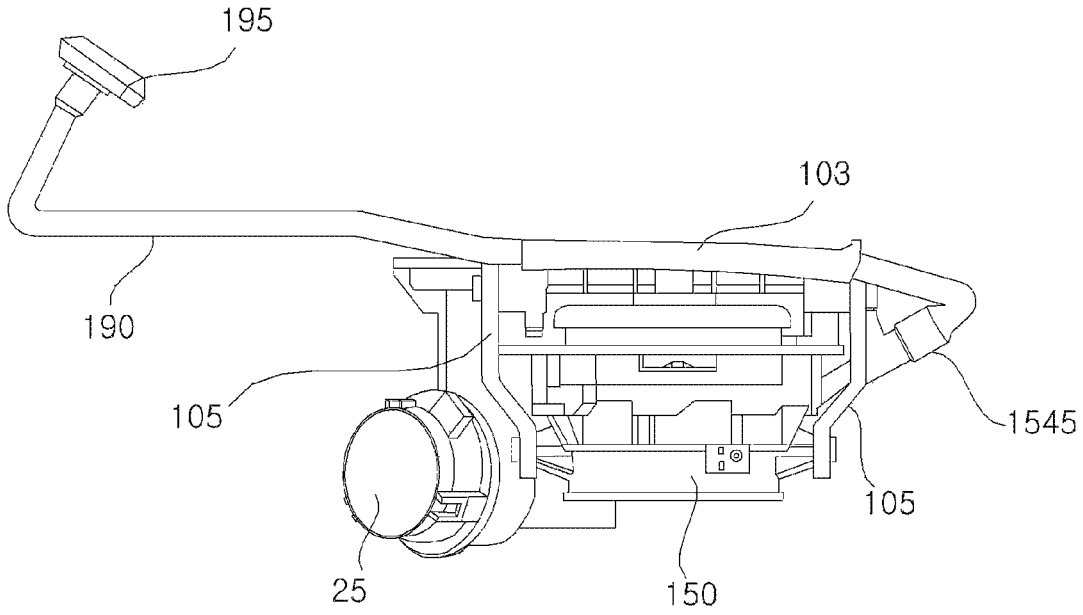
FIG. 8 is a side view of a part of a dishwasher according to an embodiment of the present invention.
Figure 9:
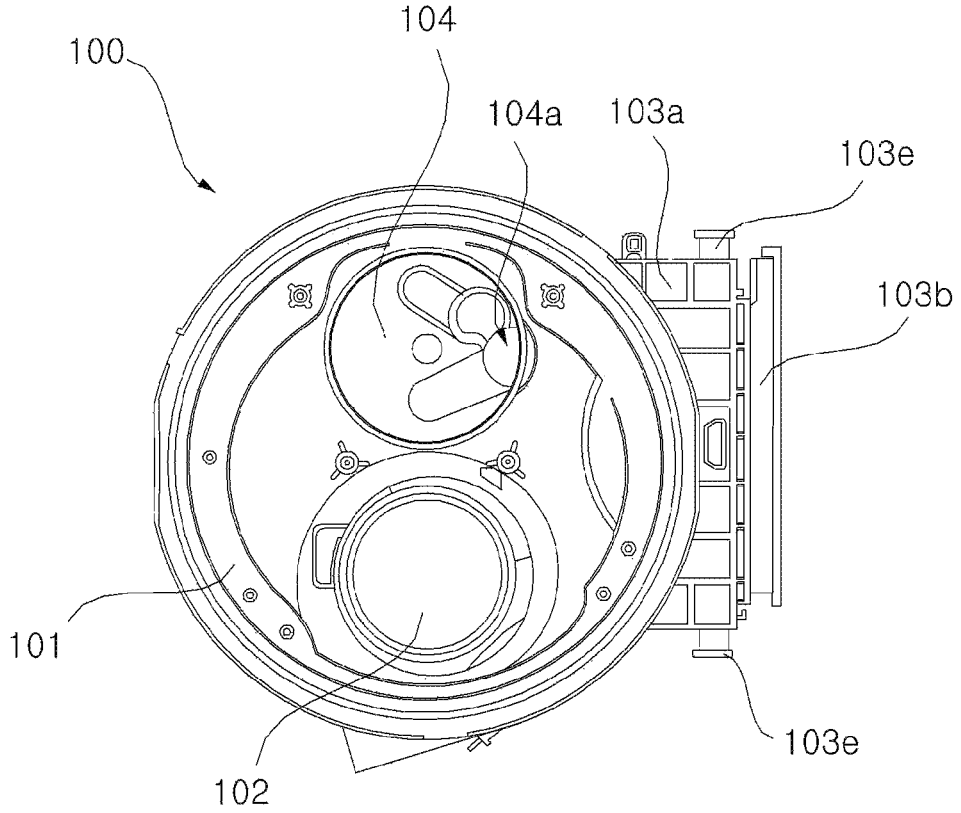
FIG. 9 is a plan view of a sump of a dishwasher according to an embodiment of the present invention.
Figure 10:
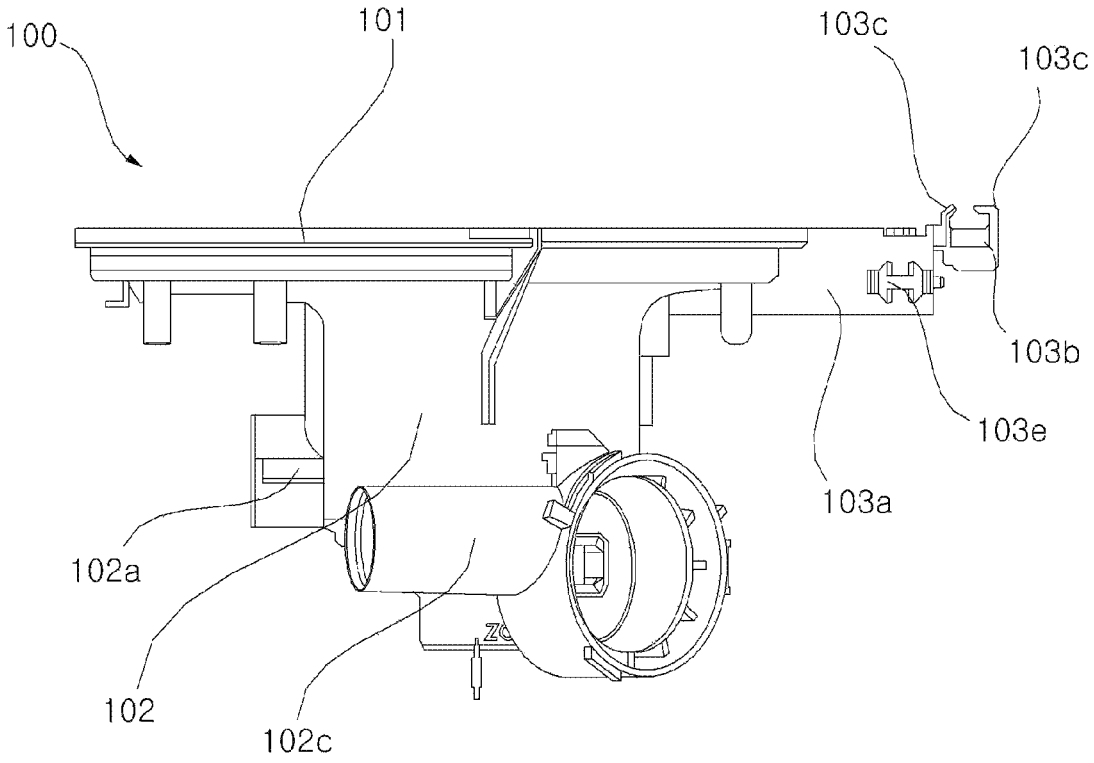
FIG. 10 is a side view of a sump of a dishwasher according to an embodiment of the present invention.
Figure 11:
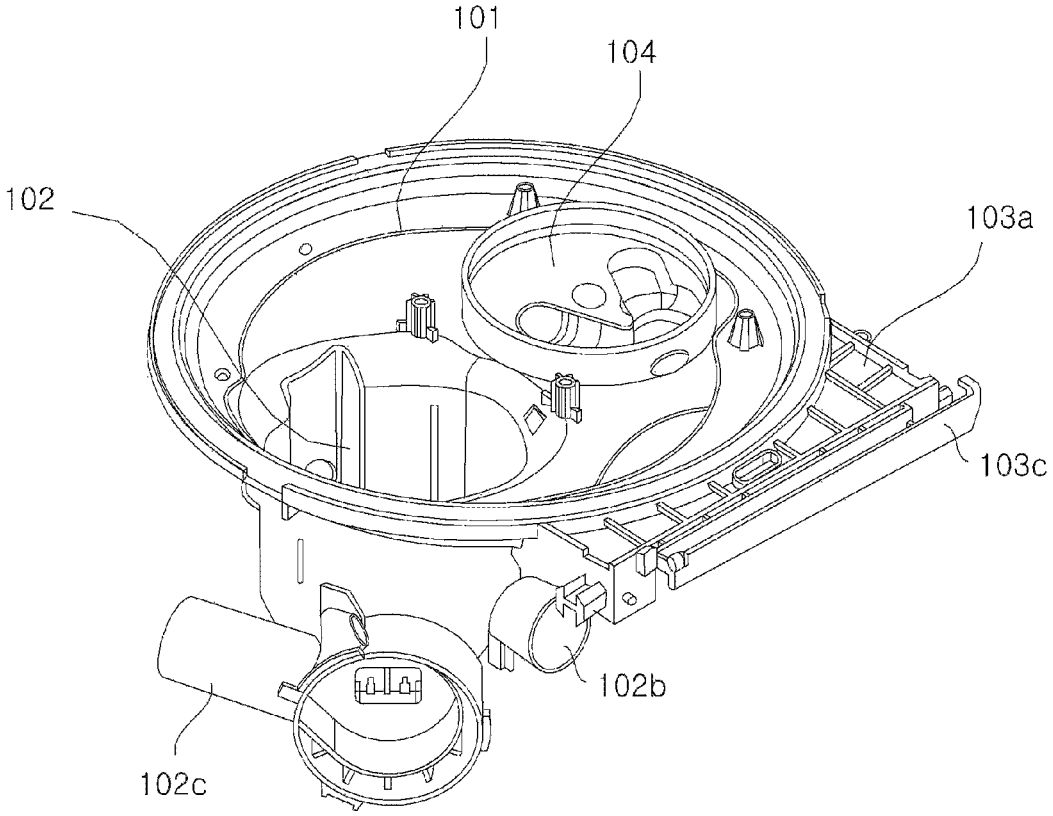
FIG. 11 is a perspective view of a sump of a dishwasher according to an embodiment of the present invention.

FIG. 7 is a plan view of a part of a dishwasher according to an embodiment of the present invention, FIG. 8 is a side view of a part of a dishwasher according to an embodiment of the present invention, FIG. 9 is a plan view of a sump of a dishwasher according to an embodiment of the present invention, FIG. 10 is a side view of a sump of a dishwasher according to an embodiment of the present invention, and FIG. 11 is a perspective view of a sump of a dishwasher according to an embodiment of the present invention.

The sump 100 according to an embodiment of the present invention includes: a sump body 101 coupled to a bottom 12*b* of the tub 12; a water collection unit 102 in which washing water is collected; a steam hose supporter 103 extending in a horizontal direction from the sump body 101 and supporting the steam hose 190; a valve coupling portion 104 in which the switch valve 130 is disposed; and a washing pump connection member 105 connecting the steam hose supporter 103 and the washing pump 150.

The sump body 101 is disposed under the bottom 12*b* of the tub 12 and coupled to the tub 12. The sump body 101 is roughly in a disk shape. A slope for guiding washing water to the water collection unit 102 may be formed on the top surface of the sump body 101.

The water collection unit 102 is formed in a cylindrical shape to store collected washing water. The water collection unit 102 is disposed under a communication hole 12C of the tub 12 to correspond to the communication hole 12*c*. A water supply pipe 102*a*, a drain part 102*c*, and a water collection pipe 102*b* are formed on a side surface of the water collection unit 102. The water supply pipe 102*a* is connected to the water supply passage 23 such that washing water supplied from an external water source flows into the water collection unit 102. The drain part 102*c* has a drain pump 25 mounted thereto and is connected to the drain passage 24 such that washing water in the water collection unit 102 flows out. The water collection pipe 102*b* is connected to the water collecting passage 170 such that the washing water in the water collection unit 102 flows out.

The switch valve 130 is provided in the valve coupling portion 104. The valve coupling portion 104 may be a part of the switch valve 130. The valve coupling portion 104 is roughly in a circular shape. A supply hole 104*a* communicating with the washing water supply passage 180 is formed in the valve coupling portion 104.

The steam hose supporter 103 extends in a horizontal direction from one end of the sump body 102 to thereby support the steam hose 190. When a direction in which the door 20 is disposed with reference to the sump body 101 is a front direction, the stem hose supporter 103 extends in a lateral direction that is a direction vertical to the front direction. The steam hose supporter 103 is disposed higher than an upper end of the steam discharge pipe 1545 of the washing pump 150 and lower than a lower end of the steam nozzle 195. The steam hose supporter 103 is disposed to cover at least a part of a top surface of the washing pump 150, especially at least a part of a top surface of the motor 157 of the washing pump 150.

The steam hose supporter 103 includes: a supporting main body 103*a* which has a disk shape; a support end 103*b* which extends horizontally from the supporting main body 103*a* to support the steam hose 190; a support protrusion 103*c* which protrudes upwardly from the support end 103*b*; and a washing pump connecting protrusion 103*e* which protrudes horizontally from the supporting main body 103*a*.

The supporting main body 103*a* extends horizontally from one end of the sump body 101. The supporting main body 103*a* is in a plate shape, which consists of an arc-shaped surface connected to the sump body 101 and other three surfaces. One side of a lateral direction (a direction which is vertical to the aforementioned forward direction) of the supporting main body 103*a* is connected to the sump body 101, and the other side thereof is connected to the support end 103*b*. One side of a forward-rearward direction (a direction which is parallel to the aforementioned forward direction) of the supporting main body 103*a* and the other end thereof are connected to the washing pump connecting protrusion 103*e*.

The supporting end 103*b* extends in a lateral direction from the supporting main body 103*a*. The supporting end 103*b* is in a beam shape of which longitudinal direction is the front-forward direction. A top surface of the support end 103*b* is brought into contact with a bottom of the steam hose 190 to support the steam hose 190. The support end 103*b* is formed such that a surface (the top surface) thereof in contact with the steam hose 190 is inclined upwardly. A direction in which the surface of the support end 103*b* is inclined upwardly is set with reference to a steam flow direction. A portion of the steam hose 190 being supported by the support end 103*b* is inclined upwardly with reference to the steam flow direction.

A plurality of support protrusions 103*c* protrudes upwardly from both side ends of the support end 103*b*. The plurality of support protrusions 103*c* is formed to surround a side surface and a part of a top surface of the steam hose 190. The support protrusions 103*c* fixes the steam hose 10. A longitudinal cross-sectional view of a lateral direction of the support end 103*b* and the support protrusion 103*c* is in a "U" shape.

The washing pump connecting protrusion 103*e* protrudes in the front-rear direction from the supporting main body 103*a*. The washing pump connecting protrusion 103*e* may be provided as a plurality of washing pump connecting protrusions. The washing pump connecting protrusion 103*e* protrudes from the supporting main body 103*a* in a longitudinal direction of the support end 103*b*. The washing pump connecting protrusion 103*e* is coupled to the washing pump connection member 105.

The washing pump connection member 105 fixes the washing pump 150 to the sump 100. The washing pump connection member 105 may be provided as a plurality of washing pump connection members 105. An upper end of the washing pump connection member 105 is connected to the washing pump connecting protrusion 103*e* of the steam hose supporter 103, and a lower end thereof is connected to the housing 152 of the washing pump 150.

Due to the above-described structure, the steam hose 190 is disposed to be inclined upwardly from the washing pump 150 with reference to a steam flow direction, or disposed to face a horizontal direction. That is, the steam hose 190 is disposed not to have a portion that is inclined downwardly with reference to the steam flow direction.

Although the exemplary embodiments have been illustrated and described, embodiments are not limited to the above-described particular embodiments, various modifications are possible by those skilled in the art without departing from the scope and spirit as disclosed in the accompanying claims and these modifications should not be understood separately from the scope and spirit.

What is claimed is:

1. A dishwasher comprising:

a case;

a tub located inside of the case, the tub defining a washing space configured to receive one or more objects;

a spray arm configured to spray washing water into the tub;

a sump located vertically below the tub and configured to store washing water;

a washing pump that is configured to receive water from the sump, that is configured to supply washing water received from the sump to the spray arm, and that is configured to generate steam from washing water received from the sump;

a steam nozzle configured to spray steam generated in the washing pump to the washing space; and a steam hose that connects the washing pump to the steam nozzle, wherein the sump comprises a steam hose supporter configured to support the steam hose.

2. The dishwasher of claim 1, wherein the washing pump comprises a steam discharge pipe configured to connect to the steam hose and configured to discharge steam to the steam hose, and wherein the steam hose supporter is located vertically above an upper end of the steam discharge pipe and vertically below a lower end of the steam nozzle.

3. The dishwasher of claim 2, wherein the washing pump further comprises an outflow pipe that is configured to discharge washing water from the washing pump and that is connected to the spraying arm, and wherein the steam discharge pipe extends from a side of the outflow pipe.

4. The dishwasher of claim 2, wherein the steam discharge pipe extends in a direction inclined upward with respect to a bottom of the washing pump.

5. The dishwasher of claim 1, wherein the sump further comprises a connection member that connects the steam hose supporter to the washing pump and that couples the washing pump to the sump.

6. The dishwasher of claim 1, wherein the steam hose supporter is configured to cover at least a part of a top surface of the washing pump.

7. The dishwasher of claim 6, wherein the washing pump comprises:

an impeller configured to cause washing water to flow outward from the washing pump; and a motor configured to rotate the impeller, and wherein the steam hose supporter covers at least a part of a top surface of the motor.

8. The dishwasher of claim 1, wherein the steam hose extends from the washing pump to the steam nozzle in a direction inclined upward with respect to a bottom the washing pump or in a horizontal direction with respect to the bottom the washing pump.

9. The dishwasher of claim 1, wherein the sump further comprises a sump body coupled to a bottom of the tub, and wherein the steam hose supporter extends from the sump body in a horizontal direction with respect to the bottom of the tub.

10. The dishwasher of claim 1, wherein the steam hose supporter comprises:

a support main body having a plate shape that extends in a horizontal direction with respect to a bottom of the sump; and a support end having a beam shape that extends from the support main body in the horizontal direction, the support end being configured to support the steam hose, and wherein the support end includes a surface that is configured to contact the steam hose and that is inclined upward with respect to the bottom of the sump.

11. The dishwasher of claim 10, wherein the steam hose supporter further comprises a support protrusion that protrudes upward from the support end and that surrounds a side surface of the steam hose and a part of a top surface of the steam hose.

12. The dishwasher of claim 1, further comprising a door located at a front surface of the tub and configured to open and close at least a portion of the washing space, wherein the steam nozzle is located at the door.

13. The dishwasher of claim 12, wherein the steam hose extends from the steam hose supporter toward the door.

14. The dishwasher of claim 13, wherein the steam hose extends from the steam hose supporter to the door in a direction inclined upward with respect to a bottom of the washing pump or in a horizontal direction with respect to the bottom of the washing pump.

15. The dishwasher of claim 1, wherein the washing pump includes an impeller that is located in an upper portion of the washing pump and that is configured to cause washing water to flow outward from the washing pump, and wherein the steam hose is connected to the upper portion of the washing pump.

16. The dishwasher of claim 8, wherein the steam hose includes a first portion that extends from the washing pump in the direction inclined upward with respect to the bottom the washing pump and a second portion that extends in the horizontal direction with respect to the bottom the washing pump.

17. The dishwasher of claim 12, wherein the steam nozzle is located at a lower portion of the door and is configured to spray steam to the washing space in a direction inclined upward with respect to a bottom of the tub.

18. The dishwasher of claim 5, wherein the connection member comprises a plurality of connection members that are arranged about the washing pump and that extend downward from the steam hose supporter to a lower portion of the washing pump.

19. The dishwasher of claim 1, wherein the steam hose is arranged along a bottom surface of the tub.

20. The dishwasher of claim 3, wherein the outflow pipe extends from an upper portion of the washing pump in a horizontal direction with respect to a top surface of the washing pump, and wherein the steam discharge pipe extends vertically above the top surface of the washing pump.

* * * * *